US005112251A

United States Patent [19]

Cesar

[11] Patent Number: 5,112,251

[45] Date of Patent: May 12, 1992

[54] ELECTRICAL CONNECTOR FOR CONNECTING A SHIELDED MULTICONDUCTOR CABLE TO AN ELECTRICAL ASSEMBLY LOCATED INSIDE A CHASSIS

[75] Inventor: Charles Cesar, Saint Martin D'Heres, France

[73] Assignee: Bull S.A., Paris, France

[21] Appl. No.: 651,345

[22] PCT Filed: Jun. 13, 1990

[86] PCT No.: PCT/FR90/00415

§ 371 Date: Mar. 27, 1991

§ 102(e) Date: Mar. 27, 1991

[87] PCT Pub. No.: WO90/16096

PCT Pub. Date: Dec. 27, 1990

[30] Foreign Application Priority Data

Jun. 15, 1989 [FR] France ..... 89 07945

[51] Int. Cl.[5] ..... H01R 13/648

[52] U.S. Cl. ..... 439/607; 439/108

[58] Field of Search ..... 439/95, 100, 101, 108, 439/607, 608, 609, 610

[56] References Cited

U.S. PATENT DOCUMENTS 4,536,045 8/1985 Reichardt et al. ..... 439/610
4,708,412 11/1987 Hines, Jr. et al. ..... 439/95
4,738,637 4/1988 Asick et al. ..... 439/610

*Primary Examiner*—Neil Abrams
*Assistant Examiner*—Khiem Nguyen
*Attorney, Agent, or Firm*—Weingarten, Schurgin, Gagnebin & Hayes

[57] ABSTRACT

An electrical connector for joining a shielded multiconductor cable to an electric assembly located within a metal chassis. The connector includes first and second connector parts which are matable at the metal chassis opening. The matable connector part which is attached to the shielded cable contains covers which secure sheets of conductive material in place on opposite sides of the connector part, so that continuity of shielding protection between the metal chassis and shielded cable is afforded when the connector parts are mated.

17 Claims, 8 Drawing Sheets

60
43
20
24
29
18
17
50
11
70
55
42
54
71
16
10

ELECTRICAL CONNECTOR FOR CONNECTING A SHIELDED MULTICONDUCTOR CABLE TO AN ELECTRICAL ASSEMBLY LOCATED INSIDE A CHASSIS

FIELD OF THE INVENTION

The present invention relates to an electrical connector for connecting a shielded multiconductor cable to an electrical assembly located inside a chassis.

BACKGROUND OF THE INVENTION

In the technology of building electronic equipment used for telecommunications and, in particular, for data processing, widespread use is made of electrical assemblies of varying degrees of complexity such as electrical recorders or electronic circuits operating by pulses for example, which are particularly sensitive to the disturbing effects of electromagnetic radiation generated by other electrical circuits outside these assemblies. This is why these electrical assemblies, in order to be protected against this parasitic radiation, are generally enclosed in a metal chassis which both mechanically supports and electrically shields the electrical assembly.

The electrical assemblies enclosed in these chassis consume electrical current and are generally supplied by electrical generators designed to deliver electrical currents whose voltage, intensity, and/or frequency characteristics must meet specific conditions in order to allow these assemblies to operate correctly. Some of these electrical generators, such as those delivering DC voltages of several tens of volts for example, can be accommodated inside the same chassis as that containing the consumer assembly supplied by these generators. Other generators on the other hand, such as those known as "undulators" for example, cannot be accommodated inside the chassis in which the consumer assembly they supply is located since these generators often cause relatively substantial high-frequency electromagnetic radiation requiring strong shielding which makes them particularly bulky. Moreover, these generators, because of the relatively high electrical voltages—on the order of a few hundreds of volts—prevailing inside them, require careful electrical insulation, and locating them in the chassis containing the assembly to be supplied would probably be hazardous for persons servicing this equipment if, for any reason, these generators had defective insulation. Since each of these generators is located in a different chassis from the chassis containing the consumer assembly to be supplied, it is necessary, to ensure the electrical connection between a generator and this assembly, to use a shielded multiconductor cable whose conducting wires establish the essential links between the electrical circuits of the generator and those of the consumer assembly, whose shielding sheath is connected to the two chassis containing this generator and this consumer assembly.

To allow this shielded multiconductor cable to be easily disconnected from one or the other of these two chassis, in order, in particular, to replace a faulty generator or consumer assembly by another generator or another consumer assembly, in the prior art, shielded connectors of the type described and shown in U.S. Pat. No. 3,904,265 have been used, this connector being composed of two connector parts, the first of which, integral with a chassis, has an insulating body provided with sockets into which are inserted contact elements of a first type (female for example), these contact elements being connected to the circuits of a generator assembly or the consumer assembly contained in this chassis, and the second of which [connector part], attached to one end of the multiconductor cable, has an insulating body provided with sockets into which are inserted contact elements of a second type (male for example) designed to be placed in contact with the contact elements of the first type when these two connector parts are coupled together, these contact elements of the second type being connected to the conducting wires of the multiconductor cable. The insulating body of the first connector part is provided with a first shielding element made of a conducting material, the first element being electrically connected to the metal chassis. Likewise, the insulating body of the second connector part is provided with a second shielding element which, also made of a conducting material, is electrically connected to the shielding sheath of the cable.

These two shielding elements are shaped so that they match each other when the two connector parts are coupled, ensuring continuous shielding between the multiconductor cable and the metal chassis.

In an electrical connector of this type, it is necessary for the various component parts of the connector to be machined and matched with very great precision so that, when the two connector parts are coupled, the contact elements, which are relatively small, can be placed in contact with each other under a specific mechanical pressure, and so that the shielding elements can fit into each other with as little play as possible. As a result, not only is the manufacturing of such a connector, which requires perfect positioning of the various component parts with respect to each other, particularly time-consuming and expensive, but the repeated connection and disconnection operations of the two connector parts, which require relatively large mechanical forces because the two shielding elements are fitted together, eventually cause misalignment of the contact elements, which of course is likely to cause deterioration of these contact elements, leading to rapid failure of the connector.

SUMMARY OF THE INVENTION

The present invention overcomes these disadvantages and proposes an electrical connector designed to allow the connection of a shielded multiconductor cable to an electrical assembly (power generator or consumer) enclosed in a metal chassis, which ensures continuous shielding between this cable and this chassis without thereby requiring expensive shielding elements and requiring relatively large mechanical forces when the two connector parts are coupled and uncoupled.

More specifically, the present invention relates to an electrical connector for allowing a multiconductor cable provided with a shielding sheath to be connected electrically to an electrical assembly located inside a metal chassis, this connector including a first connector part that includes an insulating body provided with contact elements of a first type electrically connectable to said electrical assembly, this body being adapted to be made integral with said chassis, and disposed within an opening made in a housing panel of this chassis; and a second connector part including an insulating body having a coupling face adapted to be brought at least into the vicinity of the insulating body of said first part when these two parts are coupled together, the body of the second part also having faces adjacent to said coupling face, the latter insulating body being provided with sockets into which are inserted contact elements of a second type designed to be connected to the contact elements of said first connector part when these two parts are coupled together, these contact elements of the second type being electrically connected to the conductors of said shielded cable, said connector being characterized by the insulating body of said second connector part being provided, on at least one of said adjacent faces, with a sheet of conducting material connected to the shielding sheath of said shielded cable, said sheet having a flexible part extending essentially toward said first connector part when the latter is coupled to said second connector part, this flexible part having a length such that, when these two connector parts are coupled together, it is able to be in elastic contact with said housing panel and thus ensure shielding continuity to protect the electrical circuits against the effects of external electromagnetic radiation.

DESCRIPTION OF THE DRAWING

The present invention will be better understood and other goals, details, and advantages thereof will emerge from the following description, provided as a nonlimiting example with reference to the attached drawings wherein.

DETAILED DESCRIPTION

Figure 1:
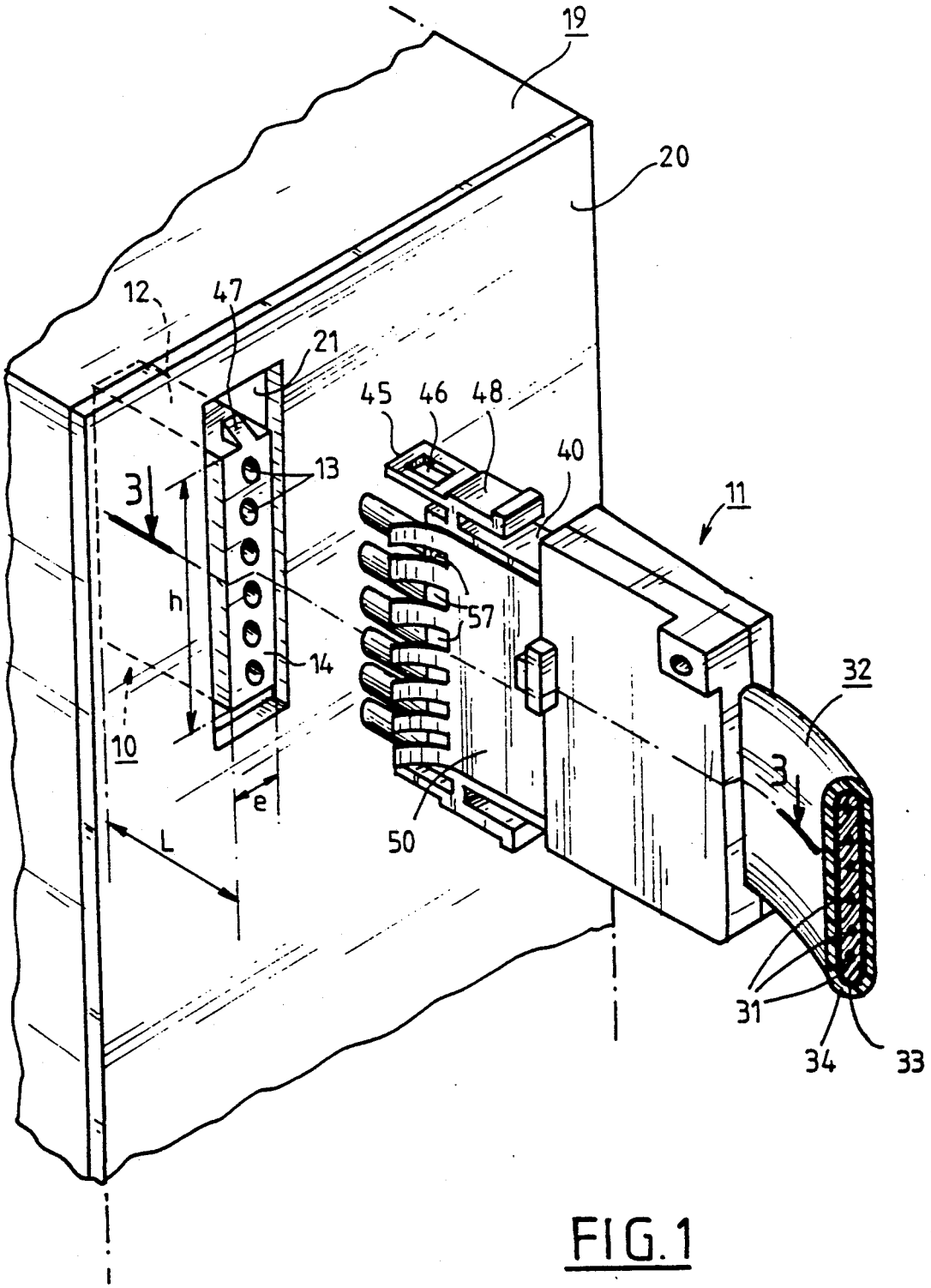
FIG. 1 is a perspective view showing an electrical connector according to the invention for connecting a shielded multiconductor cable to an electrical assembly enclosed in a chassis, this connector being equipped with shielding parts designed according to a first embodiment.

The connector shown in FIG. 1 has two connector parts 10 and 11 which can be coupled to each in a manner indicated below. Connector part 10 has a parallelepipedic insulating body 12 whose width e is relatively small by comparison to its length L and height h. This is why, in the example described, this height h is essentially equal to five times the value of width e. This body 12 is made of an insulating material with high mechanical strength and excellent electrical insulation for the contact elements, such as for example the acetal resin sold commercially under the name "Delrin" (registered trademark) or the polycarbonate sold commercially under the name "Makrolon" (registered trademark). Insulating body 12 is provided with cylindrical sockets 13 which pass through the thickness of this body and which end at the two parallel faces 14 and 15 of this body that have the values e and h indicated above for their dimensions. In FIG. 1, only face 14, which constitutes the coupling face of connector part 10 is visible, while face 15, which is located to the rear of part 10, as can be understood by referring to FIG. 3, is not visible.

Figure 3:
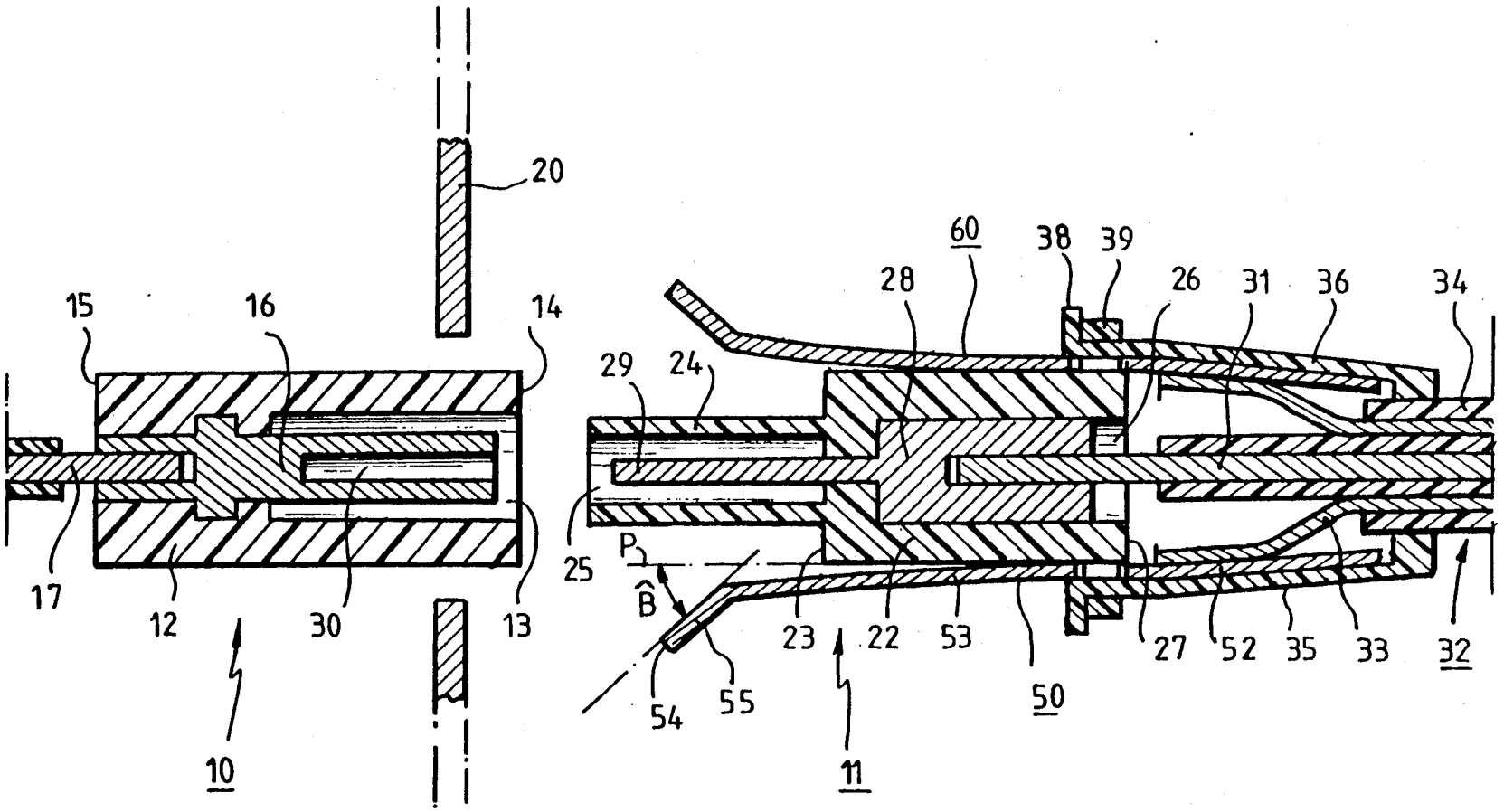
FIG. 3 is a cross section in a plane along line 3.3 in FIG. 1, showing the positions occupied by the various connector parts when the two parts of this connector are uncoupled.

Into each of sockets 13 of insulating body 12 is inserted a contact element of the type designated by reference 16 in FIG. 3. In the example illustrated in FIG. 3, each of the contact elements inserted in these sockets 13 is of the female type and has a hollow part 30. As can be seen from FIGS. 3 and 4, each contact element 16 is connected at its end at face 15 to a sheathed conducting wire 17 which provides the electrical link between this contact element and an electrical assembly 18. It will be considered that this electrical assembly is normally enclosed inside a metal chassis shown in part in FIG. 1, which chassis, marked 19, serves both as a mechanical support and as electrical shielding for this assembly.

Chassis 19, parallelepipedic in shape, has housing panels which delimit the space inside this chassis. One, 20, of the four vertical housing panels of this chassis has a rectangular opening 21 opposite which is disposed connector part 10, which connector part is located inside chassis 19 and is made integral with this chassis by means of fastening means of a known type (not shown). The position of connector part 10 is such that its coupling face 14 is flush with or extends slightly beyond the plane of housing panel 20, which allows the connector part 11, which is outside chassis 19, to be connected to connector part 10, in a manner explained below.

Figure 2:
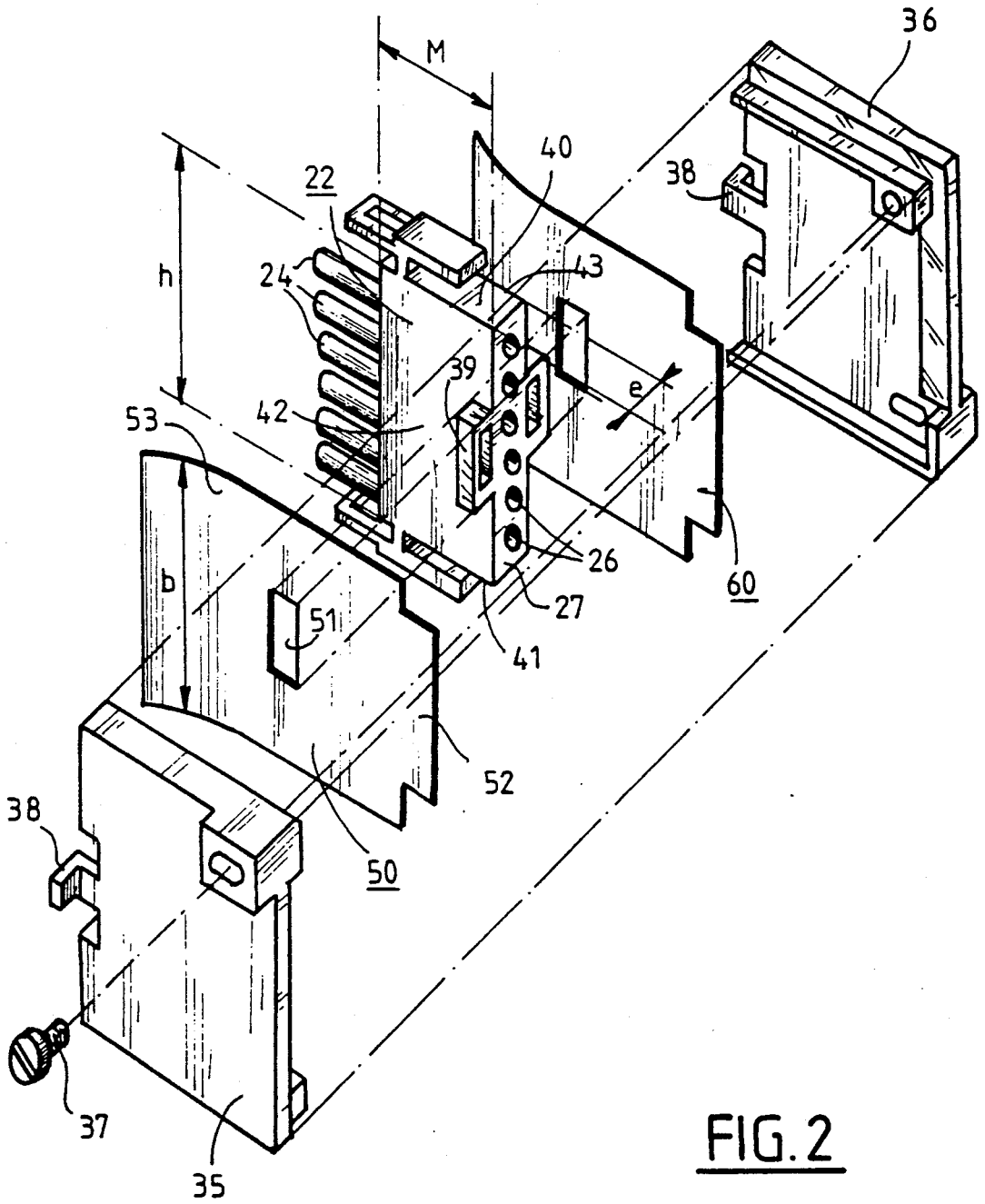
FIG. 2 is a perspective view, with exploded parts, showing the composition of the connector part which, in FIG. 1, is attached to one end of a shielded multiconductor cable.

As can be seen from FIG. 2, connector part 11, which is shown exploded in this figure, has a parallelepipedic insulating body 22 which has essentially the same width e and the same height h as those of insulating body 12 of connector part 10, which insulating body 22 thus has two faces each of which has dimensions e and h. Only one, 27, of these two faces can be seen in FIG. 2. The other face, designated 23 in FIG. 3, is the coupling face of connector part 11, said coupling face 23 being adapted to come in contact with, or least into the immediate vicinity of, coupling face 14 of connector part 10 when these two parts 10 and 11 are coupled together. FIG. 2 shows that insulating body 22 has four faces 40, 41, 42, and 43 which are adjacent to coupling face 23, two of which, 42 and 43, are oriented vertically in the figure, each of these two faces having the dimensions h and M, M being the length of insulating body 22. In the position illustrated in FIG. 2, faces 40 and 41 are the upper face and lower face respectively of insulating body 22. This insulating body 22 is made of an insulating material similar to that constituting insulating body 12 of connector part 10. FIGS. 2 and 3 show that insulating body 22 is provided, on its coupling face 23, with hollow insulating pins 24, in a number equal to the number of sockets 13 in insulating body 12, each of these hollow pins being adapted to fit into one of the sockets 13 when parts 10 and 11 are coupled. Each of these pins 24 is provided with a cylindrical cavity 25 into which, when the pin is inserted into a socket 13, contact element 16 located in this socket fits. Each cylindrical cavity 25 communicates with a socket 26 which, starting at coupling face 23, passes through the thickness of insulating body 22 and exits at face 27 of this body which is opposite coupling face 23.

This socket 26 receives a contact element 28 ending in a rod 29 which, extending along the axis of cylindrical cavity 25, is inserted into hollow part 30 of contact element 16 when the two connector parts 10 and 11 are coupled. Each contact element 28 is connected, by its end at face 27, to each of conducting wires 31 of a shielded multiconductor cable 32 (FIG. 1), these conducting wires being located inside a shielding sheath 33 made of an electrically conducting material, this sheath being itself enclosed in an envelope 34 made of insulating material. The connector part 11 shown in FIG. 2 also has two insulating covers 35 and 36 that are removable and can be fastened to each other by screw 37. These two covers 35 and 36, each provided with a curved leg 38 insertable into a stirrup 39 formed by molding onto insulating body 22, are intended to protect the end part of shielded multiconductor cable 32 on which connector part 11 has been attached, ensuring, as can be seen from FIG. 3, reinforcement of the mechanical rigidity of this end portion, which reduces the likelihood of cable 32 separating from connector part 11 when this part is repeatedly coupled to and uncoupled from connector part 10. In addition, these two covers, which are located on either side of this end portion of cable 32, as can be seen in FIG. 3, when they are connected together, prevent the bare end of shielding sheath 33 of this cable from being deformed when this cable is handled, thus causing undesired contact of conducting wires 31 with each other through this sheath 33.

Figure 4:
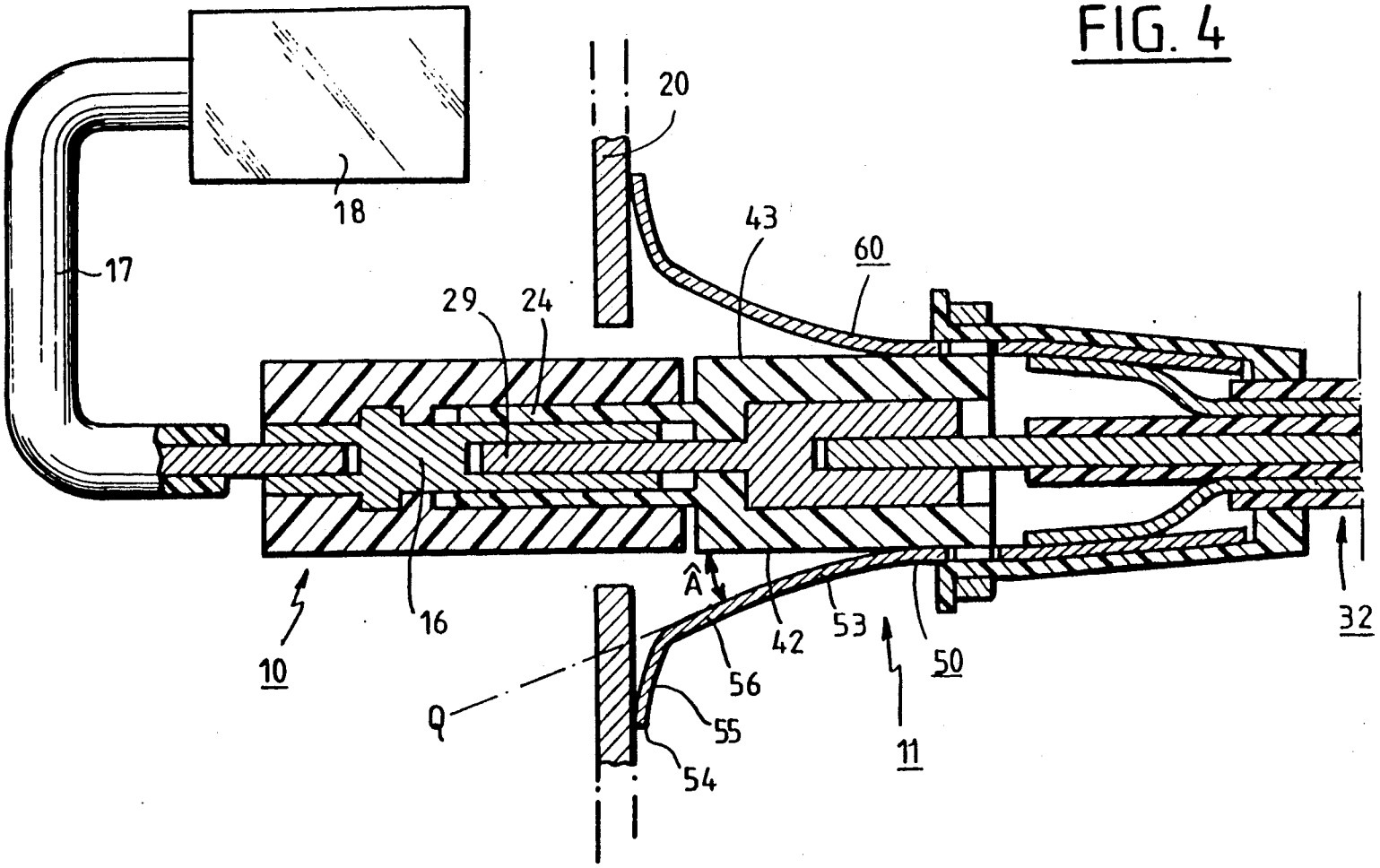
FIG. 4 is a cross-sectional view in a plane along line 3.3 in FIG. 1, showing the positions occupied by the various connector parts when the two parts of this connector are coupled.

FIGS. 3 and 4 show how, in an operation coupling the two connector parts 10 and 11, each of hollow pins 24 of part 11 is inserted into the free space of each of sockets 13 of part 10, i.e. in the part of the socket not occupied by contact element 16 which is in this socket, while simultaneously each of rods 29 penetrates into its respective hollow part 30 of contact elements 16. In order to reduce the force necessary for this operation, while ensuring a good electrical contact between each of these rods 29 and each of these contact elements 16, sockets 13, hollow pins 24, and contact elements 16 are dimensioned such as to allow a small amount of play between each socket and each hollow pin inserted into this socket and between each hollow pin and each contact element 16 inserted into this hollow pin. On the contrary, hollow parts 30 and rods 29 are made such that introduction of a rod 29 into a hollow part 30 is accomplished with slight friction of the surfaces of these parts, placed into contact. It can be seen from a comparison of FIGS. 3 and 4 that, at the end of the coupling operation of the two connector parts 10 and 11, coupling faces 14 and 23 of these two parts are in the immediate vicinity of each other. In order to prevent undesired uncoupling of the two connector parts 10 and 11, for example under the action of the vibrations engendered, during operation, by device 18 enclosed in chassis 19, these two parts are provided with a locking device which, in the example described, is composed of a hooking leg 45 (FIG. 1) made of a material similar to that of which insulating body 22 is composed, which is flexibly attached to upper face 40 of this body 22, this leg 45 being provided with an opening 46 in which, when the two connector parts 10 and 11 are coupled to each other, a lug 47 formed by molding on the upper face of connector part 10 engages. Leg 45 is integral with an activating tongue 48 which, when the two connector parts 10 and 11 are coupled to each other, allows the operator to lift leg 45 to remove lug 47 from opening 46 thus releasing connector part 11 so that the latter can then be uncoupled from part 10. Another locking device, similar to that just described, is also provided on lower face 41 of connector part 11.

FIGS. 1 and 2 also show that side face 42 of insulating body 22 of the second connector part is covered with a sheet 50, made of an electrically conducting material, which is provided with a hole 51 into which, when cover 35 is removed, stirrup 39 which projects from this face 42 can be engaged. Hole 51 is dimensioned such that engagement of stirrup 39 into this hole is accomplished with very slight play so that sheet 50 cannot move on face 42 to which it has been applied. Moreover, this sheet 50 is sufficiently thin so that, once it has been applied to face 42, it does not impede introduction of curved leg 38 of cover 35 into stirrup 39 of this face, the purpose of which introduction is to ensure attachment of cover 35 to insulating body 22, which also has the effect of preventing loosening of sheet 50 from this stirrup. Sheet 50, which has thus been positioned on side face 42, has a free part 52 which, starting from face 27 of insulating body 22, extends beyond this body, i.e. to the right of body 22 shown in FIG. 3, in order to take its place in the inner space between the two insulating covers 35 and 36, against the inside face of cover 35. This free part 52 is electrically connected to shielding sheath 33 of cable 32, with this connecting operation (by soldering) being carried out after sheet 50 has been engaged, by its hole 51, onto stirrup 39 on face 42, or on the contrary, before this sheet has become engaged by this hole. Sheet 50, which has been engaged by this stirrup, also has a flexible part 53 which, as seen in FIG. 3, extends along insulating body 22, to the left thereof, i.e. essentially in the direction of first connector part 10, when second connector part 11 is positioned ready for coupling to this first connector part. In the embodiment shown in FIG. 3, this flexible part 53 has, in the vicinity of its end 54, and end portion 55 which has been slightly folded in a direction that has the effect of distancing this end 54 from plane P of side face 42, this end portion 55 forming with this plane P an angle B of less than ninety degrees. In a more particularly advantageous embodiment, this angle B is approximately forty-five degrees. Moreover, as can be understood by referring to FIGS. 3 and 4, flexible part 53 has a length such that, when connector part 11 is displaced to be coupled to connector part 10, the end portion 55 of this flexible part comes in contact with housing panel 20 just before the coupling operation of the two connector parts is complete. During this movement, as coupling faces 14 and 23 of the two connector parts approach each other, this end portion 55 is constrained, after contacting housing panel 20, to slide on the outer face of this plate in a direction tending to distance if from opening 21, which has the effect of causing flexible part 53 to bend, as shown in FIG. 4. As a result, at the end of the coupling operation, end 54 of flexible part 53 is applied to housing panel 20 with a force whose intensity is in proportion to the degree of bending of this flexible part 53. Calling a the length, b the width, and e the thickness of this flexible part 53, it has been found that when this flexible part undergoes flexion such that its end 54 is moved by a distance f with respect to its original position, the force G with which this end is applied to housing panel 20 is represented essentially by the expression:

$$G = \frac{Ee^3fb}{4a^3} \cdot \text{sine } A$$

where E is the elasticity modulus of the material of sheet 50 and A is the angle (shown in FIG. 4) between side face 42 and tangent plane Q to portion 56 of flexible part 53 which is contiguous with end portion 55 of this flexible part. In the embodiment illustrated in FIG. 4, this angle A is about twenty degrees so that the value of sine A is practically 0.4. The force G with which the flexible part of sheet 50 is applied to housing panel 20 should have a sufficient value to ensure good contact between this sheet 50 and this panel 20. However, this force should not exceed a certain limiting value above which the operation of coupling the two connector parts 10 and 11 would be difficult for the operator. To meet these conditions, the value of this force G, expressed in newtons, is preferably between 0.02b and 0.12b, where b is the length in millimeters of end 54 of this sheet. Thus, in the example described, this sheet 50 is made of steel and thus has an elasticity modulus of practically 25,000 daN/mm$^2$. Moreover, the thickness of this sheet is practically equal to 0.1 mm and its width b (FIG. 2) is practically equal to 45 mm, while flexible part 53 of this sheet is practically equal to 16 mm in length. It should also be pointed out that, in the example illustrated by FIG. 4, the travel f of end 54 of flexible part 53 is essentially equal to 4.5 mm. This being the case, the force with which this end is applied to housing panel 20 has the value of:

$$G = \frac{25{,}000 \times (0.1)^3 \times 4.5 \times 45 \times 0.4}{4 \times (16)^3} = 14.8 \times 10^{-2}\ daN$$

i.e. practically: G=1.5 newton.

It may be observed that, with a force of this value, the contact between sheet 50 and housing panel 20 is secured, particularly as the friction exerted by end 54 of this sheet, upon the coupling and uncoupling operations of the two connector parts 10 and 11, has the effect of cleaning the zone of this plate 20 which is subjected to this friction by removing from it any traces of insulating material that may form in this zone, which traces may be, for example, traces of oxides. Thus, sheet 50 provides excellent continuity between shielding sheath 33 of cable 32 and housing panel 20 which participates in the shielding of metal chassis 19. Moreover, as can be seen in FIG. 1, the end portion of sheet 50 can be provided with cuts 57 made at regular intervals and oriented in a direction perpendicular to the end of this end portion, allowing better distribution of the contact force along this end.

Conducting sheet 50 can of course be made of a conducting material other than steel, capable of undergoing small elastic deformations and resuming its initial shape when the bending force has disappeared. Thus, for example, this sheet can be made of a beryllium copper alloy. In this case, the thickness of this sheet is practically equal to 0.2 mm.

In order to improve the continuity of shielding between shielding sheath 33 of cable 32 and housing panel 20 even further, the side face 43 of insulating body 22 is also provided, as shown in FIGS. 2, 3, and 4, with a sheet of conducting material 60, which sheet is analogous to sheet 50 and is mounted in a manner similar to that of the latter sheet.

It should be pointed out that, when the two connector parts 10 and 11 are coupled, connector part 11 tends to move away from housing panel 20 under the action of the forces exerted on the end portions of sheets 50 and 60. However, since the two connector parts are fastened together by at least one of the locking devices described above, there is no risk that these two parts will uncouple as long as the locking devices have not been unlocked by the operator.

Figure 5:
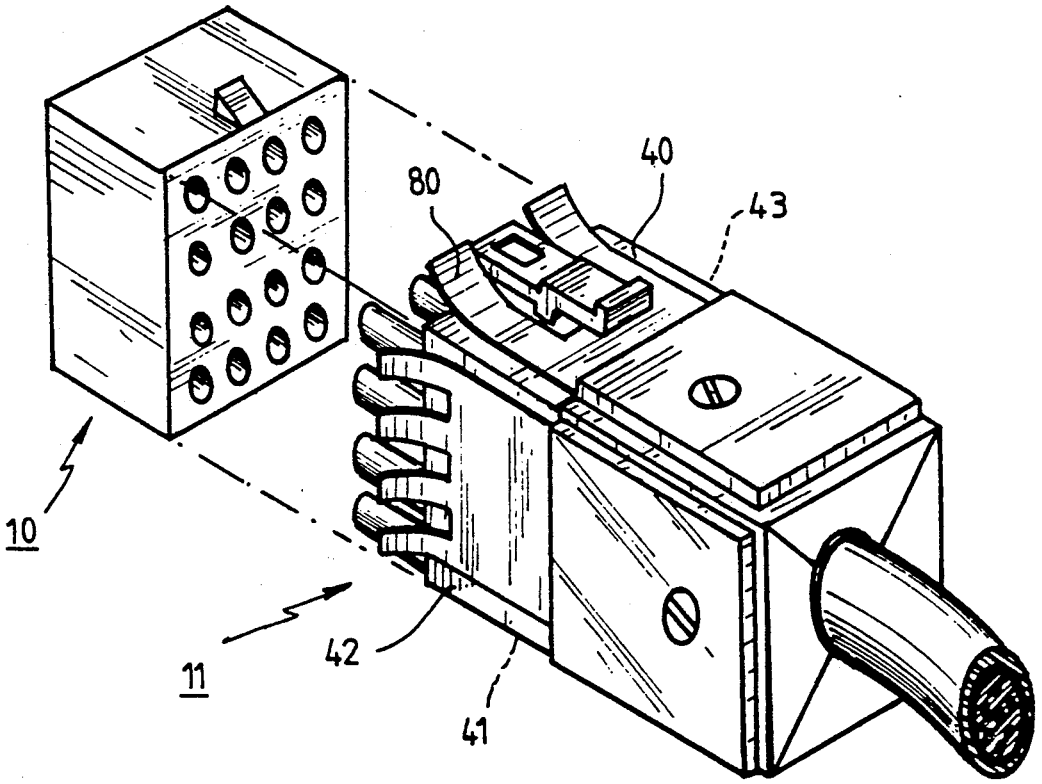
FIG. 5 is a perspective view showing another connector according to the invention but more specifically adapted to the case where the shielded multiconductor cable has a circular cross section.

In the embodiments shown in FIGS. 1 and 2, the upper face 40 and lower face 41 of insulating body 22 each have a width e which is relatively small, this width being approximately five millimeters in the example described. The surface areas of each of these two faces are relatively small so that it is not necessary to provide these faces with sheets of conducting material: sheets 50 and 60 are in fact sufficient to ensure continuous shielding of the electrical circuits against the effects of external electromagnetic radiation. On the contrary, in the other embodiments, such as that illustrated in FIG. 5 for example, insulating body 22 can have a shape in which the four faces 40, 41, 42, and 43, which are adjacent to the coupling face of this body, each have nonnegligible dimensions, i.e. at least equal to fifteen millimeters for example. In this case, to obtain effective protection against the disturbing effects of external electromagnetic radiation, it is necessary to provide each of these four faces with a sheet of conducting material, whereby some of these sheets, such as that designated 80 in FIG. 5, can be cut out in such a way as to leave uncovered the locking devices with which the faces on which these sheets are disposed are provided. The electrical connector shown in FIG. 5 is designed in particular to ensure the connection of a shielded multiconductor cable with a circular cross section.

Figure 6:
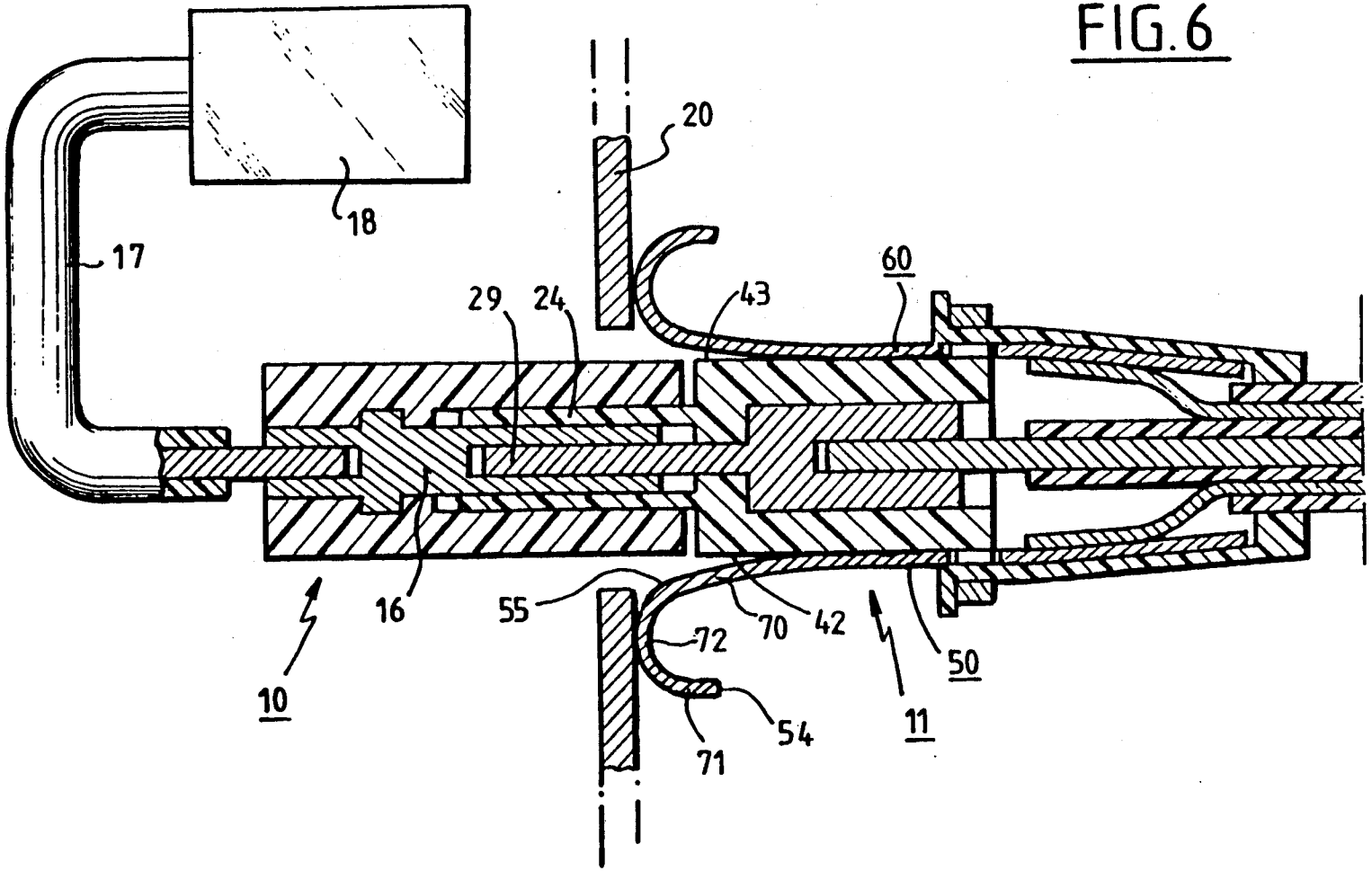
FIG. 6 is a cross-sectional view of a connector whose shielding parts are designed according to a second embodiment.

It must also be pointed out that the end portions 55 of each of the sheets of conducting material can have shapes different from that shown in FIGS. 1 to 5. Thus, in the embodiment illustrated in FIG. 6, sheet 50 mounted on face 42 of connector part 11 has, in the vicinity of its end 54, an end portion 55 which is bent such that its cross section is practically in the shape of a U, this U having two legs 70 and 71 pointing essentially in a direction parallel to the plane of face 42, these two legs being connected by a base 72 which, when the two connector parts 10 and 11 are coupled, comes in contact with housing panel 20.

Figure 7:
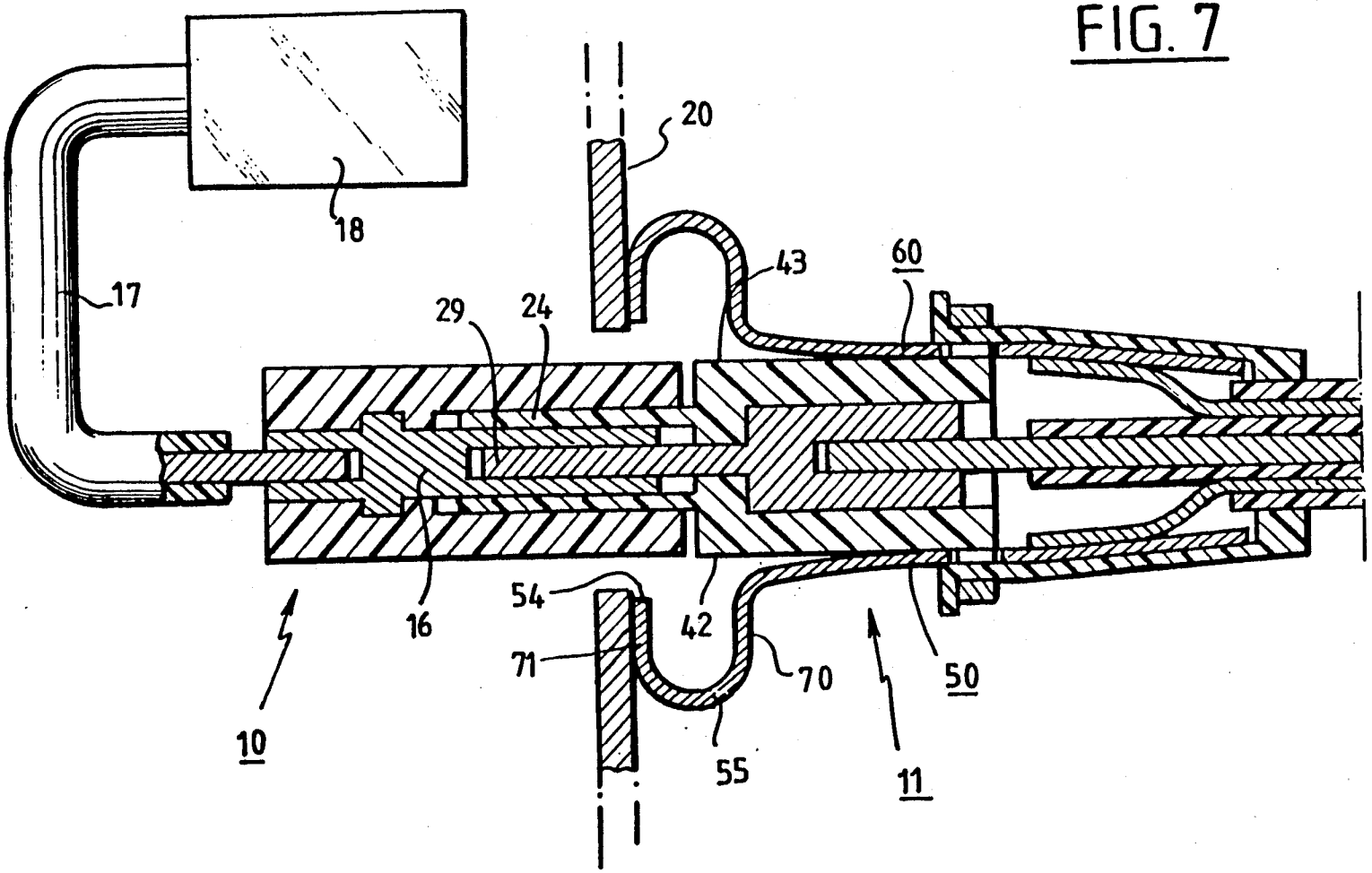
FIG. 7 is a cross-sectional view of a connector whose shielding parts are designed according to a third embodiment.

In the embodiment illustrated in FIG. 7, end portion 55 of sheet 50 has a cross section also in the shape of a U, but with the difference that the two legs 70 and 71 of this U point essentially in a direction perpendicular to the plane of face 42. FIG. 7 shows that leg 70, which is the furthest from end 54 of sheet 50, is in fact bent at practically ninety degrees to the rest of this sheet, and that leg 71, which is parallel to this leg 70, comes in contact with the outer face of housing panel 20 when the two connector parts 10 and 11 are coupled.

Figure 8:
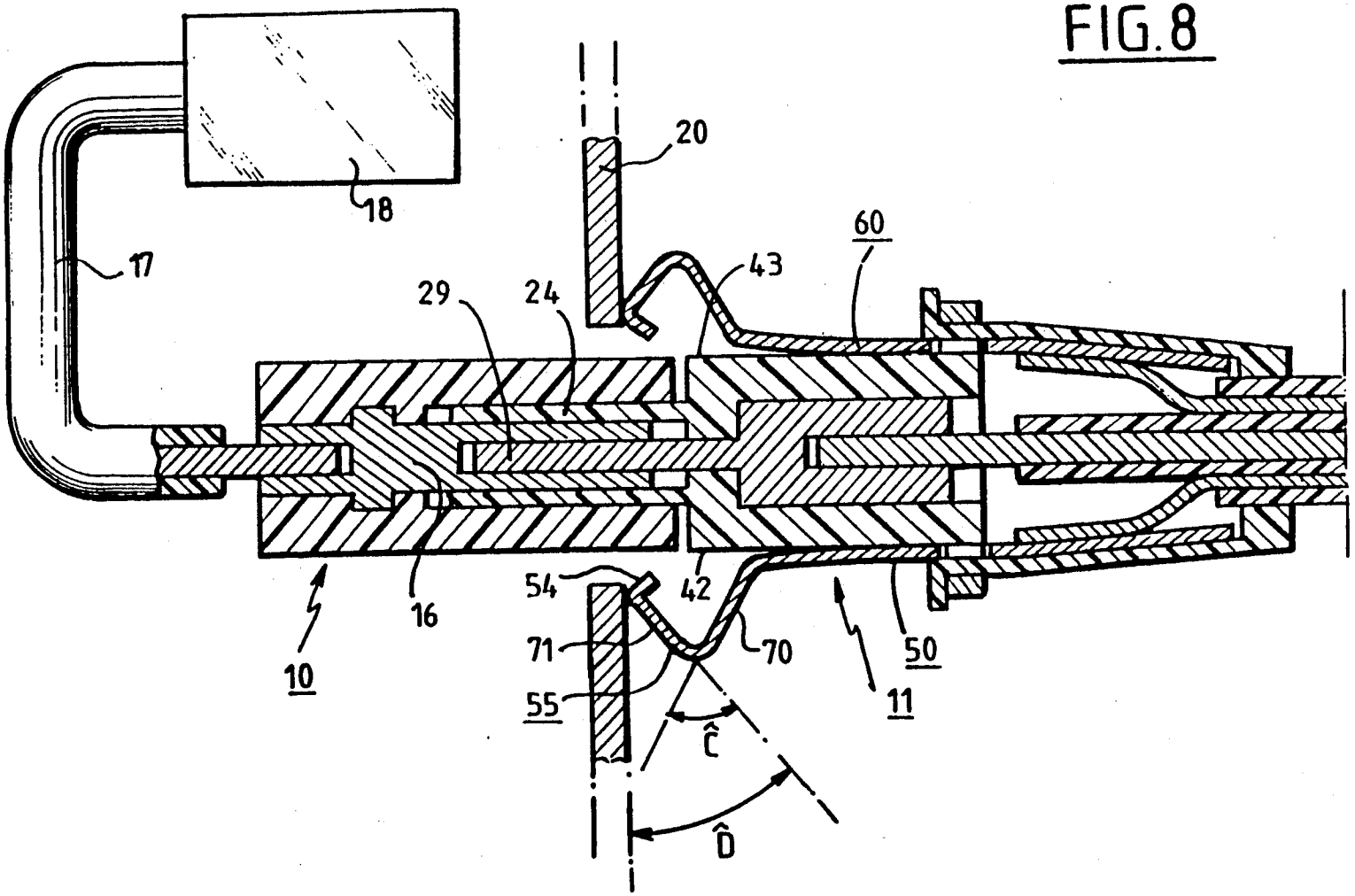
FIG. 8 is a cross-sectional view of a connector whose shielding parts are designed according to a fourth embodiment.

In the embodiment illustrated in FIG. 8, the end portion 55 of sheet 50 has a cross section essentially in the shape of a V, this V having two legs 70 and 71 which form an angle C between them, whose value is between 60° and 75°. In addition, leg 71 which is the closest to end 54 of this sheet 50, forms with housing panel 20, when the two connector parts 10 and 11 are coupled, an angle D whose value is between 15° and 25°.

Of course, the invention is not limited to the embodiments described and illustrated, which are provided only as examples. On the contrary, it comprises all means constituting technical equivalents to those described and illustrated, considered separately or in isolation, and implemented in the claims which follow.

I claim:

1. An electrical connector for connecting a multiconductor cable having shielding to a termination at an opening of a metal chassis, comprising:

a first connector part disposed at least partially within said opening of said metal chassis, said first connector part having a first plurality of electrical contact elements; and a second connector part operative to mate with said first connector part through said opening in said metal chassis, said second connector part comprising:

a second connector part insulating body having a second plurality of electrical contact elements operative to mate with said first plurality of electrical contact elements, at least one pair of sheets of conductive material disposed on opposite sides of said second connector part insulating body, each sheet being generally coextensive with said second connector part insulating body and each sheet being sufficiently sized to contact said metal chassis when said sheet is disposed on said members and said second connector part is mated with said first connector part, at least one retaining member for retaining said at least one pair of sheets of conductive material in a fixed position on said opposite sides of said second connector part insulating body; and a pair of covers operative to retain said sheets in said fixed position on said at least one retaining member and in electrical contact with said shielding of said multiconductor cable whereby a shielding is effected between said metal chassis and said multiconductor cable.

2. The electrical connector of claim 1 wherein said sheets of conductive material are angled obliquely with respect to the plane along which said sheets are disposed against said second connector part.

3. The electrical connector of claim 2 wherein said sheets of conductive material further contain ends which are obliquely angled outward.

4. The electrical connector of claim 2 wherein said sheets of conductive material are flexible.

5. The electrical connector of claim 1 wherein said sheets of conductive material have U-shaped sections disposed for contact against said metal chassis when said connector parts are coupled.

6. The electrical connector of claim 1 wherein said sheets of conducting material have U-shaped sections which exert a force against said metal chassis sufficient to ensure contact between the metal chassis and said sheets of conductive material.

7. The electrical connector of claim 1 wherein said sheets of conductive material have a V-shaped portion for disposition against said metal chassis.

8. The electrical connector of claim 1 wherein said sheets of conductive material exert a contact force against said metal chassis when said first and second connector parts are coupled.

9. The electrical connector of claim 1 wherein said sheets of conductive material comprise beryllium copper.

10. The electrical connector of claim 1 wherein said insulating body of said first connector part is mounted flush with at least one metal chassis opening integral with said metal chassis containing an electrical assembly.

11. The electrical connector of claim 1 wherein said at least one retaining member comprises at least one pair of outwardly projecting members located on opposite sides of said second connector part insulating body.

12. The electrical connector of claim 11 wherein said at least one pair of sheets of conductive material each comprise an opening conformed for a respective one of said at least one pair of outwardly projecting members to pass therethrough.

13. The electrical connector of claim 1 wherein said pair of covers are disposed on opposite sides of said second connector part and removably connected to each other by at least one screw.

14. The electrical connector of claim 1 wherein said first and second connector parts are square-shaped and said second connector part has a sheet of conductive material disposed against each of four sides.

15. The electrical connector of claim 11 wherein said outwardly projecting members are shaped as loops.

16. The electrical connector of claim 11 wherein said outwardly projecting members are shaped as stirrups and said pair of covers contain a member operative to engage said stirrups to retain said covers and said sheet in place.

17. The electrical connector of claim 1 further comprising locking means including a hooking leg flexibly attached to an upper face of said second connector part insulating body and disposed to cooperate with a leg disposed on an upper face of said first connector part.

* * * * *